US012624294B2

(12) United States Patent
Knudsen et al.

(10) Patent No.: US 12,624,294 B2
(45) Date of Patent: May 12, 2026

(54) PROCESS AND PLANT FOR IMPROVING OXYGENATE TO GASOLINE CONVERSION

(71) Applicant: Topsoe A/S, Kgs. Lyngby (DK)

(72) Inventors: Arne Knudsen, Copenhagen (DK); Kumar Rabi, Nærum (DK)

(73) Assignee: TOPSOE A/S, Kgs. Lyngby (DK)

( * ) Notice: Subject to any disclaimer, the term of this patent is extended or adjusted under 35 U.S.C. 154(b) by 206 days.

(21) Appl. No.: 18/705,225

(22) PCT Filed: Oct. 28, 2022

(86) PCT No.: PCT/EP2022/080251

§ 371 (c)(1),
(2) Date: Apr. 26, 2024

(87) PCT Pub. No.: WO2023/073199

PCT Pub. Date: May 4, 2023

(65) Prior Publication Data

US 2024/0425763 A1 Dec. 26, 2024

(30) Foreign Application Priority Data

Oct. 29, 2021 (EP) ..... 21205604

(51) Int. Cl.
*C10G 7/02* (2006.01)
*C10G 3/00* (2006.01)

(52) U.S. Cl.
CPC ..... *C10G 3/42* (2013.01); *C10G 7/02* (2013.01); *C10G 2300/4012* (2013.01); *C10G 2300/4081* (2013.01); *C10G 2400/02* (2013.01)

(58) Field of Classification Search
CPC .... C10G 3/42; C10G 7/02; C10G 2300/4012; C10G 2300/4081; C10G 2400/02; Y02P 30/20
See application file for complete search history.

(56) References Cited

U.S. PATENT DOCUMENTS 4,481,305 A 11/1984 Jorn
4,520,216 A 5/1985 Skov
(Continued)

FOREIGN PATENT DOCUMENTS

EP 3337759 A1 6/2018
WO 2017030831 A1 2/2017
(Continued)

OTHER PUBLICATIONS

International Search Report mailed on Jan. 19, 2023, by the European Patent Office for International Application No. PCT/EP2022/080251 4 Pages.
(Continued)

*Primary Examiner* — Tam M Nguyen
(74) *Attorney, Agent, or Firm* — Boone IP Law

(57) ABSTRACT

Process and plant for producing a gasoline product from an oxygenate feed stream, the process including the provision of a methanol-to-gasoline reactor in a gasoline synthesis loop. The process and plant may include combination of an overhead stream from a de-ethanizer, e.g. a fractionation column, located downstream the cooling and separation of the raw gasoline produced in the methanol-to-gasoline reactor, in the gasoline synthesis loop.

6 Claims, 2 Drawing Sheets

(56) References Cited

U.S. PATENT DOCUMENTS

| | | | | |
|---|---|---|---|---|
| 4,788,369 | A | 11/1988 | Marsh | |
| 4,929,780 | A * | 5/1990 | Wright | C07C 1/20 585/303 |
| 5,177,279 | A | 1/1993 | Harandi | |
| 9,938,205 | B2 | 4/2018 | Du | |
| 2020/0231880 | A1 | 7/2020 | Rajagopalan | |
| 2020/0354636 | A1 * | 11/2020 | Rajagopalan | C10G 3/57 |
| 2021/0078921 | A1 | 3/2021 | Harandi | |
| 2024/0124783 | A1 * | 4/2024 | Joensen | C10G 3/49 |
| 2024/0182794 | A1 * | 6/2024 | Joensen | C10G 45/64 |
| 2024/0425763 | A1 * | 12/2024 | Knudsen | C10G 7/02 |

FOREIGN PATENT DOCUMENTS

| | | | |
|---|---|---|---|
| WO | 2019020513 | A1 | 1/2019 |
| WO | 2019228797 | A1 | 12/2019 |
| WO | 2021204621 | A1 | 10/2021 |
| WO | 2022136374 | A1 | 6/2022 |

OTHER PUBLICATIONS

European Search Report mailed on Apr. 8, 2022 by the European Patent Office for European Application No. EP21205604.8, 9 Pages.
Written Opinion mailed on Jan. 19, 2023, by the European Patent Office for International Application No. PCT/EP2022/080251, 6 Pages.

* cited by examiner

PROCESS AND PLANT FOR IMPROVING OXYGENATE TO GASOLINE CONVERSION

The present invention relates to a process and plant for converting an oxygenate feed stream such as methanol e.g. e-methanol into a gasoline product including the provision of a methanol-to-gasoline (MTG) reactor in a gasoline synthesis loop. Embodiments of the invention include combination of an overhead stream from a de-ethanizer, e.g. a fractionation column, located downstream the cooling and separation of the raw gasoline produced in the MTG reactor, in the gasoline synthesis loop, i.e. combination with raw gasoline produced in the gasoline synthesis loop.

The known technology for gasoline synthesis from oxygenates such as methanol involves plants comprising a MTG section (methanol-to-gasoline section) and a downstream distillation section. The MTG section may also be referred as MTG loop or gasoline synthesis loop and comprises: a MTG reactor; a gasoline synthesis product separator for withdrawing a bottom water stream, an overhead recycle stream from which an optional fuel gas stream (also referred to as purge gas) may be derived, as well as a raw gasoline stream comprising C2 compounds, C3-C4 paraffins (LPG) and C5+ hydrocarbons (gasoline boiling components); and a recycle compressor for recycling the overhead recycle stream and combining it with an oxygenate stream, e.g. a methanol stream, thus generating the oxygenate feed stream to the MTG reactor. The overhead recycle stream (or simply, recycle stream) acts as diluent, thereby reducing the exothermicity of the oxygenate conversion. From the MTG reactor a raw gasoline stream is withdrawn and cooled in one or more heat exchangers by providing heat to the recycle stream and the combined recycle-oxygenate stream, i.e. the oxygenate feed stream. The raw gasoline is further cooled in a cooling train comprising a condenser such as an air cooler and a water cooler. In the distillation section, C2 compounds are first removed in a de-ethanizer, hereinafter also referred to as de-ethanizer column and then a C3-C4 fraction is removed as LPG as the overhead stream in a downstream LPG-splitting column (LPG splitter), while stabilized gasoline is withdrawn as the bottoms product. The stabilized gasoline or the heavier components of the stabilized gasoline, such as the C9-C11 fraction, may optionally be further treated and thereby refined, e.g. by conducting hydroisomerization (HDI) into an upgraded gasoline product.

The MTG process for producing gasoline is well-known, as for instance disclosed in U.S. Pat. Nos. 4,788,369, 4,481,305 or 4,520,216.

Normally, as for instance illustrated in appended FIG. 1, the overhead gas from the de-ethanizer, which is suitably a fractionation column, passes to an overhead system where it is condensed, and the liquid fraction is separated out in a separator, typically a 3-phase separator. Hydrocarbons in the liquid fraction are pumped back to the column as a reflux stream. Water withdrawn from the separator is sent to a process condensate stripper, while fuel gas is also withdrawn from the separator and sent to a fuel system.

When the catalyst of the MTG reactor in the gasoline synthesis loop is less active, the production of gas over the catalyst is not enough to maintain the pressure in the loop.

It would therefore be desirable to provide a process and plant (system) for gasoline production in which the gasoline loop is capable of overcoming the above problem in a simple manner.

It would also be desirable to provide better integration in the process and plant for producing a gasoline product, more particularly better integration between the MTG section (methanol-to-gasoline section) comprising the MTG reactor and gasoline synthesis product separator, and the downstream distillation section comprising the de-ethanizer a gasoline product is withdrawn and subsequent LPG-splitter from which a stabilized gasoline is withdrawn.

US2021078921 discloses methods for methanol-to-gasoline conversion featuring a separation operation following a heavy gasoline treatment, in particular methanol-to-gasoline conversion processes featuring post-processing of heavy gasoline hydrocarbons prior to forming final product gasoline.

EP337759 discloses a method converting an oxygenate feedstock, such as methanol and dimethyl ether, in a reactor containing a catalyst, such as a zeolite, to hydrocarbons, such as gasoline boiling components. The process may further comprise separating various hydrocarbons in the reactor effluent, e.g., C2-light gas can be separated from C3+ product in in the reactor effluent, in for example, a fractionating column {e.g., de-ethanizer), and additionally or alternatively, the C3+ product can be sent to a stabilizer {e.g., de-butanizer) where the C3 and part of the C4 hydrocarbon components can be removed from C5+ gasoline product.

U.S. Pat. No. 9,938,205 discloses a system and process for converting an oxygenate feedstock, such as methanol and dimethyl ether, in a fluidized bed reactor containing a catalyst to hydrocarbons, by staging the reactor, operating the reactor at a higher pressure and lower temperature, and/or providing a recycle stream, such as light olefins such as gasoline boiling components, olefins and aromatics are provided herein. Light overhead gas from a downstream de-ethanizer is not combined with raw gasoline from the reactor.

US 2020/0231880 discloses a system and method for conversion of methanol to gasoline with integrated paraffin conversion. This citation is at least silent on: combining a raw gasoline stream from a methanol to gasoline reactor with an overhead stream comprising C2 compounds generated in a downstream de-ethanizer; and/or operating the de-ethanizer at a higher pressure than the operating pressure of the methanol to gasoline reactor.

Accordingly, in a first aspect, the present invention is a process for producing a gasoline product from an oxygenate feed stream, the process comprising the steps of:

i) conducting the oxygenate feed stream to an oxygenate-to-gasoline reactor, suitably a methanol-to-gasoline (MTG) reactor, under the presence of a catalyst active for converting oxygenates in the oxygenate feed stream to a first raw gasoline stream comprising C3-C4 paraffins and C5+ hydrocarbons;

ii) combining the first raw gasoline stream with at least a portion of overhead gas stream comprising C2-compounds of step iv), and conducting the thus combined first raw gasoline stream as a second raw gasoline stream to a gasoline synthesis product separator; and withdrawing from the gasoline synthesis product separator: a bottom water stream, an overhead recycle stream from which an optional fuel gas stream, i.e. purge gas stream, may be withdrawn, as well as withdrawing a third raw gasoline stream comprising the C3-C4 paraffins (LPG), C5+ hydrocarbons (C5+ hydrocarbons including gasoline boiling components) and further comprising C2 compounds;

iii) conducting the overhead recycle stream to the oxygenate-to-gasoline reactor by means of a recycle compressor for generating a compressed overhead recycle stream, and combining the compressed overhead recycle stream with an oxygenate stream, such as a methanol stream, for producing said oxygenate feed stream;

iv) conducting the third raw gasoline stream comprising the C3-C4 paraffins (LPG), C5+ hydrocarbons and further comprising C2 compounds to a de-ethanizer i.e. a de-ethanizer column such as fractionation column; and withdrawing from the de-ethanizer: a bottom gasoline stream comprising C3-C4 paraffins, in particular the main part of the C3-C4 paraffins, and C5+ hydrocarbons as said gasoline product, and an overhead gas stream comprising C2 compounds;

wherein the process further comprises:

v) operating the de-ethanizer at a higher pressure than the operating pressure of the oxygenate-to-gasoline reactor.

By operating the de-ethanizer at a higher pressure than the gasoline synthesis, the gas from the de-ethanizer can be send back to the cooling train e.g. to the condenser in the gasoline synthesis loop. This provides gas for maintaining the gasoline synthesis pressure when the catalyst is less active, while at the same time providing high integration in the process.

As used herein, the term "integration" means that one or more units operations pertaining to a stand-alone unit in the distillation section, here in particular the de-ethanizer, becomes part of the gasoline synthesis loop; and/or that a process step in the de-ethanizer, such as cooling, correspond to process conditions in the gasoline synthesis loop. More generally, the term "integration" means providing synergy of the gasoline synthesis loop (MTG section) and distillation section of the process and plant.

As used herein, the term "comprising" includes also "comprising only", i.e. "consisting of".

As used herein, the term "suitably" means optionally, i.e. an optional embodiment.

As used herein, the term "invention", "present invention" and "present application" may be used interchangeably.

As used herein, the term "first aspect of the invention" refers to the process of the invention, and the "second aspect of the invention" refers to the plant of the invention.

Other definitions are provided in connection with one or more of below embodiments.

It would be understood, that in an embodiment, the oxygenate-to-gasoline reactor is a methanol-to-gasoline (MTG) reactor.

It would be understood that, in an embodiment, the oxygenate is methanol.

More generally, in an embodiment, the oxygenate is methanol, dimethyl ether (DME), or combinations thereof; optionally further in a admixture with a higher alcohol, the higher alcohol being any of ethanol and propanol, or combinations thereof.

In an embodiment, the oxygenate-to-gasoline reactor is operated in the pressure range 15-25 bar (absolute pressure) and the de-ethanizer is operated in the pressure range 16-30 bar, such as 20-30 bar.

These particular ranges of pressure are advantageous: at higher pressures in the oxygenate-to-gasoline reactor, the pressure is more difficult to control; at lower pressure the gasoline yield decreases. Normally, the de-ethanizer is operated at pressures of 10-15 bar; while by the present invention, the pressure is purposively not only higher than normal operating pressures in the de-ethanizer, but also higher than that of the oxygenate-to-gasoline reactor. This is surprising as the skilled person would normally desire to reduce the pressure in the de-ethanizer in order to reduce operating costs, whereas it now turns out that by increasing the pressure therein more benefits are achieved, not least reduction in equipment size or total elimination thereof and associated reduction in operating costs connected to the reflux of the overhead stream from the de-ethanizer.

In an embodiment, the oxygenate-to-gasoline reactor is operated at pressures of 15-100 bar, such as at 50 or 75 bar, and an external gas source, such as natural gas, is introduced to said overhead recycle stream or to the said oxygenate feed stream.

It is highly desirable to be able to operate the oxygenate-to-gasoline reactor at pressures higher than 25 bar, as i.a. MTG reactor size can be reduced significantly. Yet, higher pressures than 25 bar are more difficult to control. By introducing i.e. adding an external gas source, such as natural gas, pressures higher than 25 bar, up to 100 bar, can be established in the reactor.

In an embodiment, the catalyst in the MTG reactor comprises a zeolitic catalyst having an MFI framework such as ZSM-5, for instance ZSM-5 in its hydrogen form (HZSM-5) or a Zn-modified ZSM-5 optionally further comprising 1-5 wt % of a phosphorous compound, such as 3 wt % P; and wherein the temperature in the MTG reactor is 250-450° C., for instance in the range 280-400° C. The weight hour space velocity (WHSV) is suitably 1-6, such as 1-2, for instance 1.5 or 1.6 $h^{-1}$. Suitably also, the zeolitic catalyst has a $SiO_2/Al_2O_3$ (silica to alumina) ratio of between 50 and 300. Suitably also, MTG reactor has arranged along its length a fixed bed or a plurality of successive fixed beds comprising the catalyst.

As used herein, the term "MFI structure" means a structure as assigned and maintained by the International Zeolite Association Structure Commission in the Atlas of Zeolite Framework Types, which is at http://www.iza-structure.org/databases/or for instance also as defined in "Atlas of Zeolite Framework Types", by Ch. Baerlocher, L. B. McCusker and D. H. Olson, Sixth Revised Edition 2007.

In an embodiment, the catalyst is arranged in the oxygenate-to-gasoline reactor as a fixed bed.

In an embodiment, the oxygenate feed stream is e-methanol (electrified methanol), i.e. methanol which is produced from synthesis gas prepared by using electricity from renewable sources such as hydropower, wind or solar energy, e.g. eMethanol™. Hence, according to this embodiment the synthesis gas may be prepared by combining air separation, autothermal reforming or partial oxidation, and electrolysis of water, as disclosed in Applicant's WO 2019/020513 A1, or from a synthesis gas produced via electrically heated reforming as for instance disclosed in Applicant's WO 2019/228797. Thereby, an even more sustainable approach for the production of raw gasoline, in particular gasoline product, is achieved. While methanol can be produced from many primary resources (including biomass and waste), in times of low wind and solar electricity costs, the production of eMethanol™ enables a sustainable front-end solution. The synthesis gas, which as is well-known in the art, is a mixture comprising mainly hydrogen and carbon monoxide, for methanol synthesis it may also be prepared by combining the use of water (steam) electrolysis in an alkaline or PEM electrolysis unit or a solid oxide electrolysis cell (SOEC) unit, thereby generating hydrogen, and the use of an SOEC unit for thereby generating carbon monoxide from a $CO_2$-rich stream, as e.g. disclosed in applicant's WO 2022136374.

In an embodiment, in step ii) said at least a portion of the overhead gas stream comprising C2-compounds is conducted in direct fluid communication with the first raw gasoline stream.

The term "in direct fluid communication with the first raw gasoline stream" means that there is no intermediate step changing the properties of the overhead stream prior to being combined with the first raw gasoline stream. Thereby, in a simple manner, the de-ethanizer becomes an integral part of the MTG section of the gasoline loop.

In an embodiment, the de-ethanizer comprises a condensing unit, separator and reflux pump, and the de-ethanizer is operated in a partial reflux mode by conducting a portion of the overhead gas stream comprising C2 compounds to said condensing unit and separator; withdrawing from the separator a water stream, a fuel gas stream comprising C2-compounds and a reflux liquid stream which is pumped to the de-ethanizer.

Thereby, the process is made flexible in the operation mode that is needed. For instance, where pressure issues in the MTG catalyst bed are not critical, e.g. where the catalyst has not yet lost significant activity, operation with partial reflux in the de-ethanizer may be conducted and later, where catalyst activity loss affects the pressure in the oxygenate-to-gasoline reactor (MTG reactor), the operation with less or no reflux by directly sending more and more of the overhead stream comprising C2-compounds to the raw gasoline stream, is conducted. Hence, a gradual transition towards operation in which no reflux in the de-ethanizer is necessary, is achieved.

The term "at least a portion of the overhead gas stream comprising C2-compounds" means, in an embodiment, that a portion of the overhead stream from the de-ethanizer is combined with the first raw gasoline stream, while the other portion is withdrawn for the reflux in the de-ethanizer. The term "at least a portion of the overhead gas stream comprising C2-compounds" means, in another embodiment, that the entire overhead gas stream comprising C2-compounds.

It would be understood, that the de-ethanizer may comprise an overhead system, the overhead system being a physical section of the de-ethanizer which is arranged to receive another portion of overhead gas stream comprising C2-compounds of step iv). The overhead system comprises a condensing unit, a separator and a reflux pump.

For instance, as is well-known in the art and illustrated in FIG. 1, the de-ethanizer 26 comprises an overhead system which comprises condensing unit 28, e.g. an air cooler, separator 30 e.g. 3-phase separator, and a reflux pump 32. In FIG. 1, however, the de-ethanizer is operated in a full reflux mode, by conducting the entire overhead gas stream 19 comprising C2 compounds to the condensing unit, separator and further via reflux pump back to the de-ethanizer.

In an embodiment, in step ii) the entire overhead gas stream comprising C2-compounds is combined with said first raw gasoline stream.

Thereby, the overhead system for the de-ethanizer i.e. including condensing unit such as an air or water cooler, separator such as a 3-phase separator, and reflux pump, and which normally are provided in expensive stainless steel, is obviated. The hot overhead gas stream from the de-ethanizer is suitably sent to the gasoline synthesis loop upstream the air cooler or upstream the water cooler in the gasoline synthesis loop, as it will also become apparent from a below embodiment. Hydrocarbon and water is condensed and separated from each other and the gas in the gasoline synthesis product separator. The hydrocarbons are then supplied with the third raw gasoline to the de-ethanizer. The water from the gasoline synthesis product separator is sent to a process condensate stripper (PC-stripper). The overhead gas is following the recycle gas, as explained above, and excess gas thereof is withdrawn as said purge gas.

In an embodiment, step ii) comprises:

prior to combining the first raw gasoline stream with said at least a portion of the overhead gas stream comprising C2-compounds: cooling said raw gasoline stream by conducting the raw gasoline stream through one or more heat exchangers under the provision of a heat exchanging medium, said heat exchanging medium being: an oxygenate stream such as a methanol stream; or said oxygenate feed stream in which said oxygenate feed stream is a stream resulting from combining the compressed overhead recycle stream with said oxygenate stream; and after combining the first raw gasoline stream with said at least a portion of the overhead gas stream comprising C2-compounds, further cooling the thus combined raw gasoline stream as said second raw gasoline stream by conducting it to an air cooler and/or water cooler prior to entering said gasoline synthesis product separator.

Thereby, the partly cooled first raw gasoline stream, after delivering heat to the feed streams to the oxygenate to gasoline reactor, e.g. the oxygenate feed stream, incorporates the C2-compounds of the overhead stream from the de-ethanizer, for thereby utilizing the air cooler and/or water cooler normally used for further cooling the first raw gasoline stream, also as cooling units for the overhead stream from the de-ethanizer, as well as for utilizing the downstream gasoline synthesis product separator. Normally, as already explained, the de-ethanizer would have its own air/water cooler and separator as well as a reflux pump for providing a full reflux of the overhead liquid. By full reflux, as also recited earlier, it is meant that the entire overhead stream is withdrawn from the de-ethanizer, cooled in the air/water cooler of the overhead system of the de-ethanizer and passed to the product separator thereof, e.g. 3-phase separator, for producing a bottom liquid hydrocarbon product that is refluxed to the top of the de-ethanizer. Hence, the present invention takes at least advantage of the provision of said air cooler and/or water cooler upstream the gasoline synthesis product separator, for also condensing the hot overhead gas from the de-ethanizer, rather than this requiring its own air/water cooler in the overhead system of the de-ethanizer.

It would be understood, that the overhead gas stream comprising C2-compounds from the de-ethanizer may be combined with the first raw gasoline stream at a location in the gasoline synthesis loop upstream the air cooler or upstream the water cooler. Suitably the air cooler is provided upstream the water cooler.

In an embodiment, the overhead gas stream comprising C2-compounds is combined with said first raw gasoline stream at multiple locations prior to the gasoline synthesis product separator. Hence, the overhead gas stream comprising C2-compound is suitably split into different streams prior to mixing with the first raw gasoline stream. For instance, where the entire overhead gas stream is combined with the first raw gasoline stream, the entire overhead gas stream is split into a first stream being combined with the first raw gasoline at a location upstream the air cooler, while the second stream is combined with the first raw gasoline at a location in between the air cooler and the water cooler, as for instance illustrated in appended FIG. 2. In yet another embodiment, the overhead gas stream from the de-ethanizer is combined with the first raw gasoline at a single mixing point, e.g. a junction, either upstream the air cooler of the gasoline synthesis loop, or in between the air cooler and water cooler of the gasoline synthesis loop. This enables increased flexibility in the process and plant.

In an embodiment, the process further comprises separating from said gasoline product, i.e. the bottom gasoline stream of the de-ethanizer comprising the C3-C4 paraffins and C5+ hydrocarbons:

- a stabilized gasoline product stream comprising the C5+ hydrocarbons, and
- a stream comprising the C3-C4 paraffins.

The process may thus further comprise converting said bottom gasoline stream into a stabilized gasoline product. Refining of the bottom gasoline product is thereby achieved, while also separating a C3-C4 fraction which may be further used for producing valuable products such as aromatic compounds, e.g. via aromatization.

The separation is suitably conducted in a so-called LPG-splitting column (LPG-splitter), where a C3-C4 fraction (C3-C4 paraffins) is removed the overhead stream as LPG, while the stabilized gasoline is withdrawn as the bottoms product. The stabilized gasoline or the heavier components of the stabilized gasoline, such as the C9-C11 fraction, may optionally be further treated and thereby refined, e.g. by conducting hydroisomerization (HDI) into an upgraded gasoline product.

As used herein, the term "C3-C4 paraffins" is also referred to as "LPG". The term "LPG" means liquid/liquified petroleum gas, which is a gas mixture mainly comprising propane and butane, i.e. C3-C4; LPG may also comprise i-C4 and a minor portion of olefins.

In a second aspect, the invention is directed to a system i.e. a plant for producing a gasoline product from an oxygenate feed stream, suitably according to any of the embodiments of the process according to the first aspect of the invention, the plant comprising:

- an oxygenate-to-gasoline (MTG) reactor comprising a catalyst such as a catalytic fixed bed for converting the oxygenate feed stream into a first raw gasoline stream; the reactor being arranged to receive the oxygenate feed stream and comprising an outlet for withdrawing the raw gasoline stream;
- optionally, a feed/effluent heat exchanger which is arranged to receive said first raw gasoline stream and to receive said oxygenate-feed stream as heat exchanging medium for generating a cooled first raw gasoline stream;
- optionally one or more heat exchangers arranged downstream said feed/effluent heat exchanger to receive the cooled first raw gasoline stream and arranged to receive as heat exchanging medium an oxygenate stream such as methanol stream or an overhead recycle stream from a gasoline synthesis product separator arranged downstream, for generating a further cooled first raw gasoline stream;
- a mixing point, such as a junction or mixing unit, arranged downstream said feed/effluent heat exchanger or downstream said one or more heat exchangers, said mixing point being arranged to receive the first raw gasoline stream (5) or the cooled first raw gasoline stream or the further cooled first raw gasoline stream and an overhead gas stream comprising C2 compounds from a de-ethanizer arranged downstream, for forming a combined first raw gasoline stream as a second raw gasoline stream;
- optionally, a cooling unit, such as an air cooler and/or a water cooler, i.e. heat exchanger arranged to receive respectively air or cooling water as heat exchanging medium, arranged to receive the combined first raw gasoline stream as a second raw gasoline stream, for cooling said second raw gasoline stream;
- a gasoline synthesis product separator arranged to receive the thus cooled second raw gasoline stream or the second raw gasoline stream (27, 27"), and comprising an outlet for withdrawing a bottom water stream, an outlet for withdrawing an overhead recycle stream, and an outlet for withdrawing a third raw gasoline stream comprising C2 compounds, C3-C4 paraffins (LPG) and C5+ hydrocarbons (C5+ hydrocarbons including gasoline boiling components);
- optionally a conduit for withdrawing, from said overhead recycle stream a fuel gas stream, i.e. purge gas stream;
- a recycle compressor arranged to receive said overhead recycle stream and discharge a compressed overhead recycle stream, which is conducted to said optional feed/effluent heat exchanger and/or said optional one or more heat exchangers arranged downstream the feed/effluent heat exchanger;
- a de-ethanizer arranged downstream said gasoline synthesis product separator and further arranged to receive said third raw gasoline stream comprising C2 compounds, C3-C4 paraffins (LPG) and C5+ hydrocarbons; the de-ethanizer comprising an outlet for withdrawing a bottom gasoline stream (comprising the C3-C4 paraffins and C5+ hydrocarbons) as said gasoline product, and an outlet for withdrawing the overhead gas stream comprising C2 compounds; and wherein the de-ethanizer is arranged to operate at a higher pressure than the oxygenate-to-gasoline reactor.

By operating the de-ethanizer, i.e. fractionation column, at a higher pressure than the gasoline synthesis (in the MTG reactor), the gas from the column can be sent back to e.g. the condensing unit (air cooler) upstream the gasoline synthesis product separator. This provides gas for maintaining the gasoline synthesis pressure when the catalyst is less active.

In an embodiment according to the second aspect of the invention, the de-ethanizer is arranged to provide the entire overhead gas stream comprising C2 compounds in direct fluid communication with the first raw gasoline stream. Hence, the de-ethanizer is absent of, i.e. does not comprise, an overhead system comprising a condensing unit such as an air cooler, a separator such as a 3-phase separator, and a reflux pump.

It would be understood, that said overhead system means a physical section of the de-ethanizer which is arranged to receive a portion of overhead gas stream comprising C2-compounds of step iv) according to an embodiment of the process (first aspect) of the invention. The overhead system comprises a condensing unit, a separator and a reflux pump.

Thereby, a simpler plant for producing a gasoline product or stabilized gasoline, providing synergy between the de-ethanizer of the distillation section and the gasoline synthesis loop is achieved. Capital and operating expenditures are also reduced, as there is no need to e.g. operate with a reflux pump in the de-ethanizer. Furthermore, additional condenser, separator and pump in stainless steel, which would otherwise be required as part of the overhead system of the de-ethanizer, may now be omitted, as for instance illustrated in FIG. 2.

In an embodiment in accordance with the second aspect of the invention, the plant further comprises a LPG-splitter for converting said bottom gasoline stream into a stabilized gasoline product; in which the LPG-splitter is a fractionation column arranged to receive said gasoline product from the de-ethanizer, and comprises an outlet for withdrawing an overhead C3-C4 fraction (C3-C4 paraffins) stream as LPG stream, and an outlet for withdrawing a bottom gasoline stream as said stabilized gasoline stream.

Refining of the gasoline product is thereby achieved.

Any of the embodiments and associated benefits in accordance with the first aspect of the invention may be used in connection with the second aspect of the invention, or vice versa.

Figure 1:
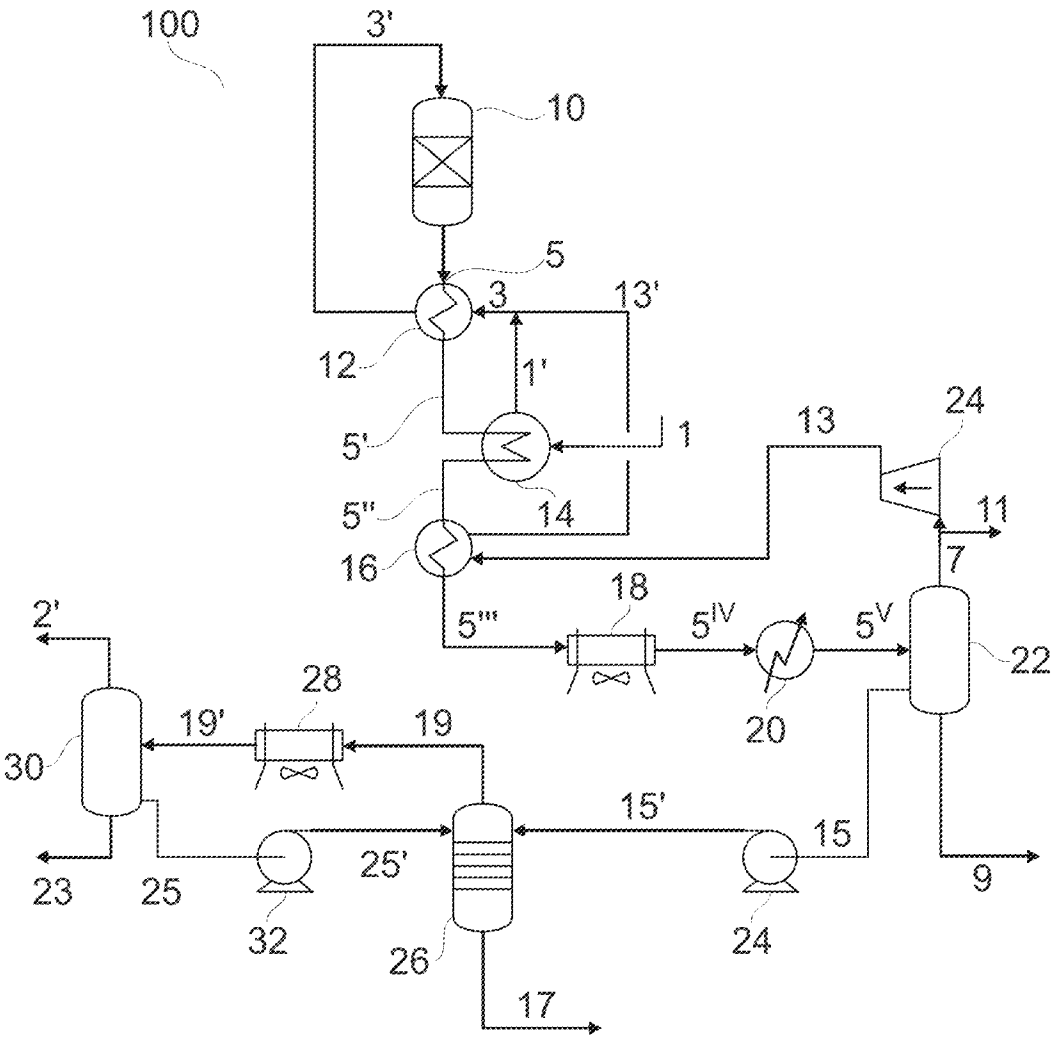
Fig. 1 Prior art
FIG. 1 shows a schematized process and plant in accordance with the prior art.

With reference to FIG. 1, a process and plant 100 according to the prior art is shown, including a gasoline synthesis loop, and the de-ethanizer of a downstream distillation section and associated overhead system of the de-ethanizer for providing a full reflux of the overhead stream, more precisely full reflux of the liquid portion thereof. More specifically, in the gasoline synthesis loop, oxygenate stream 1, suitably a methanol stream, is heated in heat exchanger 14 (boiler) to form heated oxygenate stream 1' and combined with a compressed overhead recycle stream 13' to form oxygenate feed stream 3. The oxygenate feed stream 3 is further heated in feed/effluent heat exchanger 12 by heat exchange with first raw gasoline stream 5 comprising C3-C4 paraffins and C5+ hydrocarbons, which is produced in the oxygenate-to-gasoline reactor, suitably MTG reactor 10. The cooled first raw gasoline stream 5' is further cooled in boiler 14 and heat exchanger 16 thereby forming first raw gasoline stream 5" and 5'", respectively. The heat exchanging medium in heat exchanger 16 is compressed overhead recycle stream 13 from downstream gasoline synthesis product separator 22. The thus heated compressed overhead recycle stream 13' is combined with the heated oxygenate stream 1', as explained above. The first raw gasoline synthesis stream 5'" is further cooled in air cooler 18 and water cooler 20, thereby forming further cooled first raw gasoline streams $5^{iv}$ and 5%, respectively. In the gasoline synthesis product separator 22, the entering raw gasoline stream $5^{v}$ is separated into bottom water stream 9, overhead recycle stream 7 from which an optional fuel gas stream, i.e. purge gas stream 11, is withdrawn, as well as a raw gasoline stream 15 comprising the C3-C4 paraffins (LPG), C5+ hydrocarbons and further comprising C2 compounds. The overhead recycle stream 7 is conducted to the oxygenate-to-gasoline reactor 10 by means of a recycle compressor 24 for generating the compressed overhead recycle stream 13, 13'.

The raw gasoline stream 15 comprising the C3-C4 paraffins (LPG), C5+ hydrocarbons and further comprising C2 compounds, is conducted downstream the gasoline synthesis loop to a distillation section comprising a de-ethanizer 26, suitably arranged as a fractionation column. From this unit, a bottom gasoline stream 17 comprising C3-C4 paraffins and C5+ hydrocarbons is withdrawn as gasoline product, as well as an overhead gas stream 19 comprising C2 compounds. This overhead gas stream 19 is then utilized in an overhead system comprising air cooler 28, 3-phase separator 30 and reflux pump 22. The overhead gas stream 19 is first cooled in the air cooler 28 thus forming cooled overhead gas stream 19', then conducted to the 3-phase product separator 30, from which a fuel gas stream 2' and water stream 23 are withdrawn, as well as stream 25 which is fed to the de-ethanizer 26 as a full reflux 25' via reflux pump 32.

Figure 2:
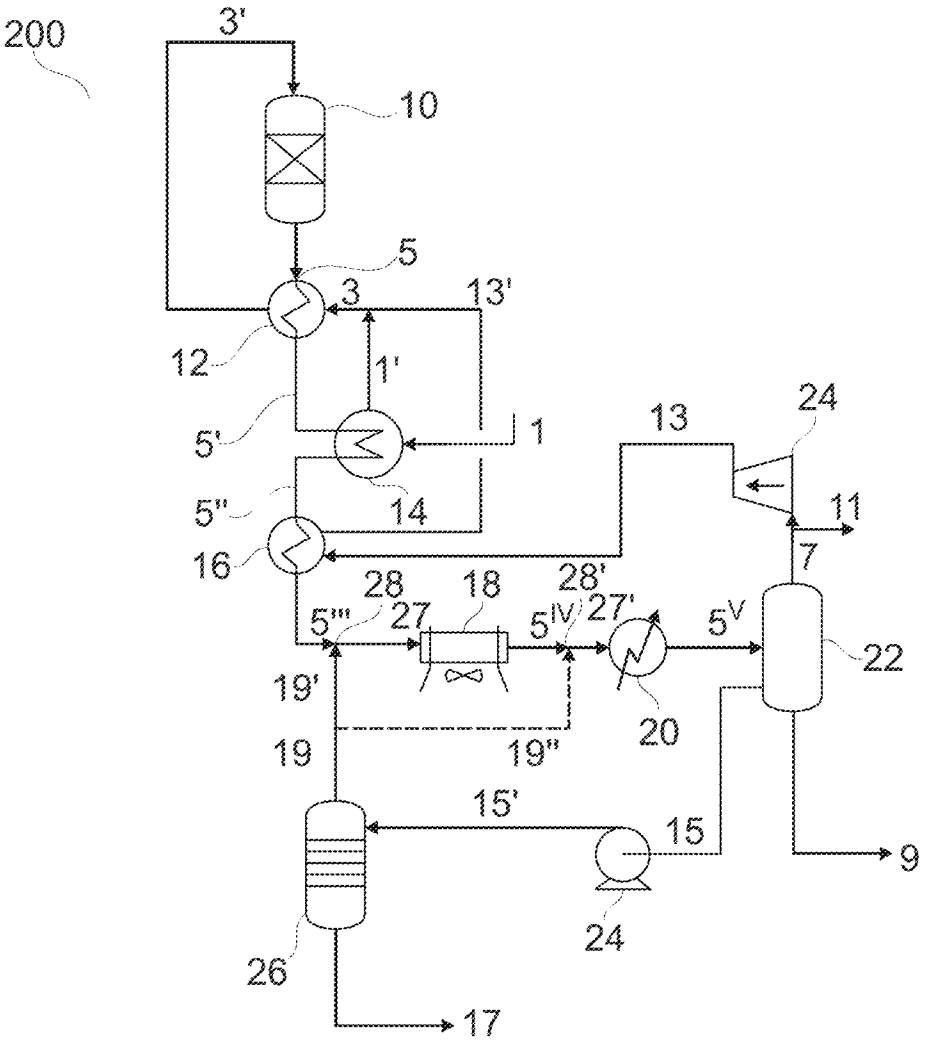
FIG. 2 shows a schematized process and plant in accordance with an embodiment of the present invention.

Now with reference to FIG. 2, a process and plant 200 according to an embodiment of the invention is shown. The streams and units correspond to those of FIG. 1, yet the de-ethanizer is now absent of the overhead system (units 28, 30, 32 of FIG. 1) and the entire overhead gas stream 19 from the de-ethanizer 26 is integrated in the gasoline synthesis loop comprising the oxygenate-to-gasoline reactor 10, heat exchangers 12, 14, 16 and cooling units 18, 20, as well as gasoline synthesis product separator 22 and recycle compressor 24. Now, the overhead gas stream 19, here the entire overhead gas stream 19 is combined with the first raw gasoline stream 5 to form a second raw gasoline stream upstream e.g. the air cooler 18 of the gasoline synthesis loop. More specifically, the specific embodiment of FIG. 2 shows the overhead gas stream 19 from the de-ethanizer 26 being split into a first stream 19' being combined with the first raw gasoline 5'" at a location such as junction 28 upstream the air cooler 18, while the second stream 19" is combined with the first raw gasoline at a location such as junction 28' in between the air cooler 18 and the water cooler 20. A combined first raw gasoline stream i.e. second raw gasoline stream 27, 27' is thus formed, which after cooling is fed as the thus cooled second raw gasoline stream $5^{iv}$, $5^{v}$ to the gasoline product separator 22. In yet another embodiment, the overhead gas stream 19, 19', 19" from the de-ethanizer 26 is combined with the first raw gasoline at a single mixing point, e.g. at junction 28 or 28', thus either upstream the air cooler 18, or in between the air cooler 18 and water cooler 20 of the gasoline synthesis loop. FIG. 2 also illustrates that the entire overhead gas stream 19 comprising C2 compounds is in direct fluid communication with the first raw gasoline stream. Hence, there is no intermediate step or associated unit changing the properties of the overhead stream prior to being combined with the first raw gasoline stream. The overhead system for the de-ethanizer 26 i.e. including condensing unit such as an air or water cooler 28, separator such as a 3-phase separator 30, and reflux pump 32, and which are normally are provided in expensive stainless-steel materials, are here obviated. The bottom gasoline stream 17 (gasoline product stream) withdrawn from the de-ethanizer 26 is suitably conducted to an LPG-splitter (not shown) for converting the bottom gasoline stream into a stabilized gasoline product.

The invention claimed is:

1. Plant for producing a gasoline product from an oxygenate feed stream comprising:

an oxygenate-to-gasoline reactor comprising a catalyst for converting the oxygenate feed stream into a first raw gasoline stream; the reactor being arranged to receive the oxygenate feed stream and comprising an outlet for withdrawing the first raw gasoline stream;

a mixing point arranged downstream a feed/effluent heat exchanger or downstream one or more heat exchangers, said mixing point being arranged to receive the first raw gasoline stream or cooled first raw gasoline stream or further cooled first raw gasoline stream, and an overhead gas stream comprising C2 compounds from a de-ethanizer arranged downstream, for forming a combined first raw gasoline stream as a second raw gasoline stream;

a cooling unit arranged to receive the combined first raw gasoline stream as a second raw gasoline stream, for cooling said second raw gasoline stream;

a gasoline synthesis product separator arranged to receive the thus cooled second raw gasoline stream or the second raw gasoline stream, and comprising an outlet for withdrawing a bottom water stream, an outlet for withdrawing an overhead recycle stream, and an outlet for withdrawing a third raw gasoline stream comprising C2 compounds, C3-C4 paraffins and C5+ hydrocarbons;

a recycle compressor arranged to receive said overhead recycle stream and discharge a compressed overhead recycle stream;

a de-ethanizer arranged downstream said gasoline synthesis product separator and further arranged to receive said third raw gasoline stream comprising C2 compounds, C3-C4 paraffins and C5+ hydrocarbons; the de-ethanizer comprising an outlet for withdrawing a bottom gasoline stream as said gasoline product, and an outlet for withdrawing the overhead gas stream comprising C2 compounds; and wherein the de-ethanizer is configured to operate at a higher pressure than the oxygenate-to-gasoline reactor.

2. The plant according to claim 1, in which the de-ethanizer is arranged to provide the entire overhead gas stream comprising C2 compounds in direct fluid communication with the first raw gasoline stream.

3. The plant according to claim 1, wherein the plant further comprises:

the feed/effluent heat exchanger which is arranged to receive said first raw gasoline stream and to receive said oxygenate-feed stream as heat exchanging medium for generating the cooled first raw gasoline stream;

the one or more heat exchangers arranged downstream said feed/effluent heat exchanger to receive the cooled first raw gasoline stream and arranged to receive as heat exchanging medium an oxygenate stream, or an overhead recycle stream from a gasoline synthesis product separator arranged downstream, for generating the further cooled first raw gasoline stream;

a conduit for withdrawing, from said overhead recycle stream, a fuel gas stream.

4. The plant according to claim 3, wherein said compressed overhead recycle stream is conducted to said feed/effluent heat exchanger and/or said one or more heat exchangers arranged downstream the feed/effluent heat exchanger.

5. The plant according to claim 1, further comprising a LPG-splitter for converting said bottom gasoline stream into a stabilized gasoline product; in which the LPG-splitter is a fractionation column arranged to receive said gasoline product from the de-ethanizer, and comprises an outlet for withdrawing an overhead C3-C4 fraction stream as LPG stream, and an outlet for withdrawing a bottom gasoline stream as said stabilized gasoline stream.

6. The plant according to claim 1, configured such that the higher pressure at which the de-ethanizer is configured to be operated compared to the oxygenate-to-gasoline reactor causes said overhead gas stream comprising C2 compounds to be directed toward the mixing point.

* * * * *